US005857299A

United States Patent [19]

Gyllenberg et al.

[11] Patent Number: 5,857,299

[45] Date of Patent: Jan. 12, 1999

[54] ADJUSTABLE FRAMING SYSTEM FOR FINISHING FRAMED DOOR AND WINDOW OPENINGS

[76] Inventors: Brent C. Gyllenberg, 295 E. Campbell; P. Michael Karnowski, 1850 H St., both of Baker City, Oreg. 97814

[21] Appl. No.: 885,105

[22] Filed: Jun. 30, 1997

Related U.S. Application Data

[60] Provisional application No. 60/020,729 Jul. 1, 1996.

[51] Int. Cl. [6] ..... E06B 1/04

[52] U.S. Cl. ..... 52/217; 52/211; 52/212; 52/656.2; 52/656.4; 52/656.5; 52/585.1; 49/504; 49/505

[58] Field of Search ..... 52/211, 212, 217, 52/717.01, 718.05, 718.02, 656.2, 656.4, 656.5, 656.7, 656.9, 585.1; 49/504, 505

[56] References Cited

U.S. PATENT DOCUMENTS

| | | | |
|---|---|---|---|
| 4,193,238 | 3/1980 | Chalmers et al. | 52/718.05 X |
| 4,813,204 | 3/1989 | Rentschler | 52/217 |
| 4,920,718 | 5/1990 | Artwick et al. | 52/476 |
| 4,989,381 | 2/1991 | De Block et al. | 52/204 |
| 5,133,168 | 7/1992 | Neilly et al. | 52/585 |
| 5,233,802 | 8/1993 | Rogers | 52/212 |
| 5,261,203 | 11/1993 | Yoon | 52/656.9 X |
| 5,644,881 | 7/1997 | Neilly | 52/656.5 X |
| 5,653,074 | 8/1997 | Yoon | 52/656.4 X |

*Primary Examiner*—Christopher Kent
*Assistant Examiner*—Yvonne Horton-Richardson
*Attorney, Agent, or Firm*—Joseph W. Holland

[57] ABSTRACT

A modular finishing system for framed door or window openings which is adjustable for varying depths of door or window casings. The modular finishing system for framed door or window openings has opposing first and half subassemblies which may be prefabricated. Each subassembly includes casing and trim components. To erect, one subassembly is inserted within the framed door or window opening, one subassembly from each side of the opening. The subassemblies are slideably and adjustably engageable one with the other by a mechanism extending between the first subassembly inner edge and the second subassembly inner edge. In the preferred embodiment of the invention, a cam shim is provided which assists and simplifies squaring the subassemblies within the framed opening.

16 Claims, 7 Drawing Sheets

ADJUSTABLE FRAMING SYSTEM FOR FINISHING FRAMED DOOR AND WINDOW OPENINGS

RELATED APPLICATIONS

This application claims the priority of Provisional application Ser. No. 60/020,729, entitled *Adjustable Framing System for Finishing Framed Door and Window Openings*, filed Jul. 1, 1996

FIELD OF THE INVENTION

The present invention relates generally to construction methods and materials and more specifically to methods and components for finishing a framed window or door opening.

BACKGROUND OF THE INVENTION

Conventional home and building construction is a time consuming and expensive process with costs for conventional construction rising presently in many parts of the country to over $100/square foot. It is therefore desirable to cut costs in the construction process where feasible. From the owner's perspective it is of equal or greater importance that quality and appearance of the finished product not be diminished simply to achieve marginal cost reduction.

In conventional home and building construction, one of the most time consuming phases of the construction process is the finish work for doors and windows. Additionally, the finish work for doors and windows is always a key focus of architectural detail, readily observed by those who frequent a building. Hence, there is an additional emphasis on controlling costs in this phase without reducing quality.

SUMMARY OF THE INVENTION

The present invention is directed to a modular finishing system for framed openings, typically for doors and windows, which is adjustable for varying depths of door or window casings.

The door framing embodiment of the invention for finishing a framed door opening typically includes a first subassembly and a second subassembly, each having a pair of side casing members and a header casing member. Attached to the outer edge of each of the side casing members and the header casing member are trim members.

Located along the inner edges of the second subassembly side casing members and header casing member are means for permitting the adjustable engagement of the first subassembly, with the second subassembly attached to and extending between the first subassembly inner edge and the second subassembly inner edge. In the preferred embodiment of the invention, this means for permitting the adjustable engagement of the first subassembly with the second subassembly includes a plurality of dowels and holes located along the inner edges of the subassembly casing members for aligning and mating the subassemblies. Other means may be employed including mating tracks, a variety of threaded components including all-thread, and/or a variety of webbed attachments including scissored arrangements.

In order to install the door framing embodiment of the invention, the first subassembly is placed within the framed door opening and set square, shimming the casing as required. Next, the first subassembly is fixed within the opening by attaching the casing members to the framing faces and the trim members to the adjacent wall sections. The second subassembly is placed within the framed door opening from the opposite side of the wall, shimming the casing as required and aligning and mating the dowels and holes located on the inner edges of the subassemblies. The second subassembly is then fixed within the opening by attaching the casing members to the framing faces and the trim members to the adjacent wall sections. Following alignment and mating of the first and second subassemblies, a face trim member or a stop member is fastened over any gap between the first and second subassemblies which completes installation of the system. The stop members may be prefastened to the top face of the side and header casings of either the first subassembly or the second subassembly, or it may be attached to both following installation of both the first subassembly and the second subassembly.

In alternative embodiments of the invention, one of the subassemblies may include a pre-hung door mounted by hinges to a side casing member or "bi-fold" doors, sliding doors or track doors are all compatible with the described invention.

In yet another embodiment of the invention, a cam shim or a plurality of cam shims may be rotatably mounted on the dowels which are located on the inner edges of the first subassembly side casing members and header casing member. These cam shims are used in lieu of conventional wedge shims to square the face of the casing on installation. The cam shim functions simply by rotating the cam so that the desired portion of the cam lobe rests against the face of the framed opening, providing the desired offset between the casing and the framed opening, while squaring the casing within the framed opening.

An embodiment of the invention for finishing framed window openings is similar to the embodiment of the invention for finishing framed door openings in that it typically includes a first subassembly and a second subassembly, each having a pair of side casing members and a header casing member. In addition each subassembly includes a sill casing member. Attached to the outer edge of each of the side casing members, the header casing member and the sill casing are trim members.

Once again, located along the inner edges of the subassembly casing members are a plurality of holes for dowels for aligning and mating the first subassembly with the second subassembly within the framed enclosure.

Following alignment and mating of the first and second subassemblies, a trim member is fastened over any gap between the first and second subassemblies completing installation of the system.

In this embodiment of the invention for finishing framed window openings, either of the first subassembly or the second subassembly may further comprise a pre-hung window, or in the alternative may simply provide means for mounting a pre-hung or preglazed window within the subassembly following installation of the first and second subassemblies.

The window embodiment of the invention may also, as an alternative, employ the cam shim for providing the desired offset between the casing and the framed opening, and for squaring the casing within the framed opening.

This invention may be practiced in wood, metal or a variety of synthetic materials including plastics, fiberglass and other composites.

These and other features of the invention will be more fully understood and appreciated with reference to the following description, the claims and the accompanying drawings.

DETAILED DESCRIPTION OF THE INVENTION

Figure 1:
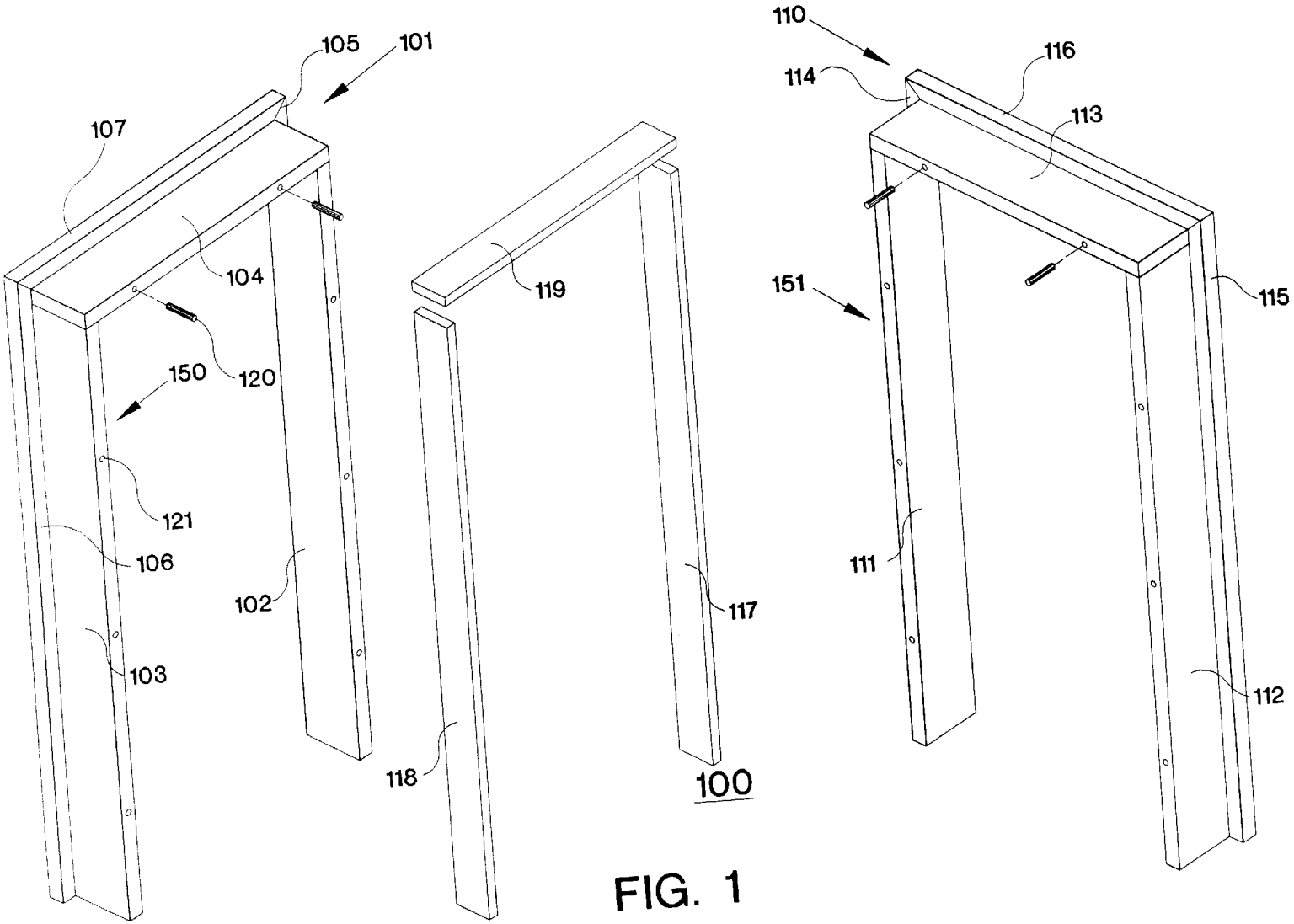
FIG. 1 is an exploded perspective representational view of one embodiment of the adjustable framing system for finishing a framed door opening.
Figure 2:
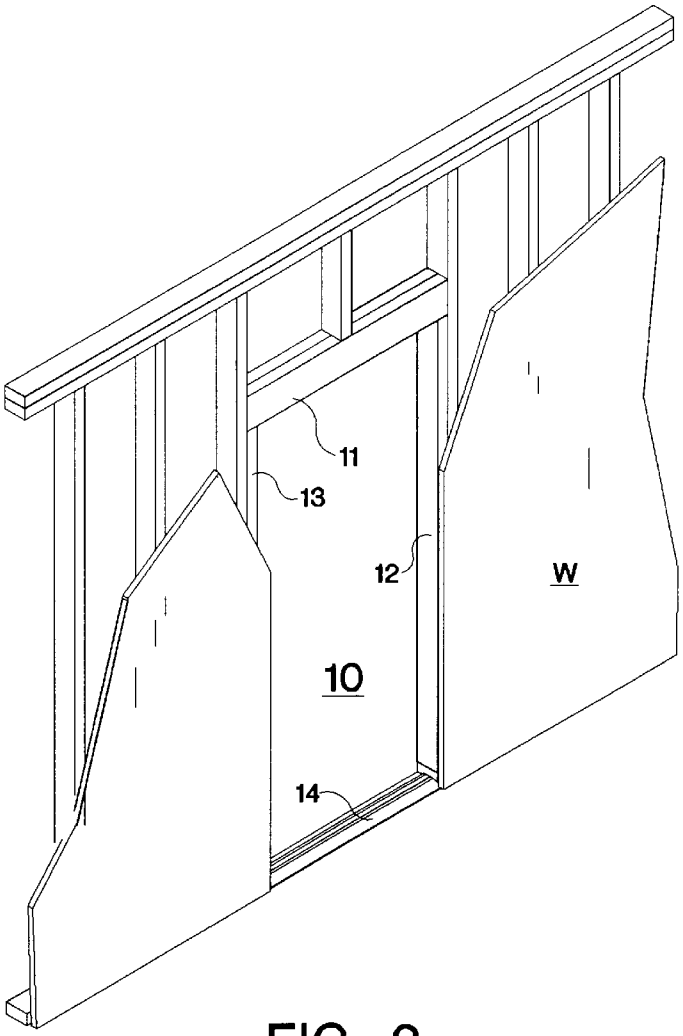
FIG. 2 is a front view of a framed door opening.

Referring now to FIGS. 1 through 6 a modular finishing system for framed door openings is more fully described. Modular finishing system for framed doors 100 is adjustable for varying depths of framed door openings 10. Referring to FIG. 2, framed door opening 10 typically includes header 11, first side frame member 12, second side frame member 13 and threshold 14. Most often, framed door opening 10 is formed utilizing framing components, typically wood or metal, having nominal or standard dimensions.

Referring to FIG. 1, modular finishing system for framed doors 100 includes first subassembly 101 which is prefabricated and includes first side casing member 102, second side casing member 103 and first header casing member 104. First side casing member 102 is configured having an inner edge, an outer edge, a back and a face. Similarly, second side casing member 103 is configured having an inner edge, an outer edge, a back and a face. First side casing member 102 is attached at is upper end to first header casing member 104. Similarly, second side casing member 103 is attached at is upper end to first header casing member 104. First header casing member 104 is also configured having an inner edge, an outer edge, a back and a face.

Attached to the outer edge of first side casing member 102 is first side casing trim member 105. Similarly, second side casing trim member 106 is attached to the outer edge of second side casing member 103. Finally, first header casing trim member 107 is attached to the outer edge of first header casing member 104.

Second subassembly 110 is similarly prefabricated and includes third side casing member 111, fourth side casing member 112 and second header casing member 113. Third side casing member 111 is configured having an inner edge, an outer edge, a back and a face. Similarly, fourth side casing member 112 is configured having an inner edge, an outer edge, a back and a face. Third side casing member 111 is attached at is upper end to second header casing member 113. Similarly, fourth side casing member 112 is attached at is upper end to second header casing member 113. Second header casing member 113 is also configured having an inner edge, an outer edge, a back and a face.

Attached to the outer edge of third side casing member 111 is third side casing trim member 114. Similarly, fourth side casing trim member 115 is attached to the outer edge of fourth side casing member 112. Finally, second header casing trim member 116 is attached to the outer edge of second header casing member 113.

Located along the inner edges of first side casing member 102, second side casing member 103, first header casing member 104, third side casing member 111, fourth side casing member 112 and second header casing member 113 are a plurality of holes 121. Each hole 121 has a longitudinal axis parallel to the face of the casing member in which the hole is formed. Additionally, each hole 121 is aligned with at least one hole 121 located along the opposing subassembly inner edge. Dowels 120 are configured so as to be slideably engagable in each hole 121.

In prefabricating first subassembly 101 and second subassembly 110, all attachments are made utilizing well known methods and all joints are made employing known joining techniques and configurations.

In use, modular finishing system for framed doors 100 is erected by first positioning first subassembly 101 within a framed door opening. As shown in FIGS. 1 through 6, first header casing member 104 extends across a portion of the face of header 11 with first header casing trim member 107 extending away from framed door opening 10 above adjacent wall section W. Similarly, first side casing member 102 extends across a portion of the face of the side frame member with first side casing trim member 105 extending away from the framed door opening adjacent to the wall section (not shown). Similarly, second side casing member 103 extends across a portion of the face of the side frame member with second side casing trim member 106 extending away from the framed door opening adjacent to the wall section (not shown).

Next, first subassembly 101 is secured within the framed door opening typically by fastening the various side casing trim members to adjacent wall section W. FIGS. 1 through 6 show first header casing trim member 107 and second header casing trim member 116 so attached to wall section W. This is typical of the arrangement and attachment of the various side casing trim members to adjacent wall sections.

Next, as shown in FIGS. 1 through 6, second subassembly 110 is erected by first positioning second subassembly 110 within framed door opening 10 so that second header casing member 113 extends across a portion of the face of header 11 with second header casing trim member 116 extending away from framed door opening 10 above adjacent wall section W. Similarly, third side casing member 111 extends across a portion of the face of the side frame member with third side casing trim member 114 extending away from the framed door opening adjacent to the wall section (not shown). Similarly, fourth side casing member 112 extends across a portion of the face of the side frame member with fourth side casing trim member 115 extending away from framed door opening 10 adjacent to the wall section (not shown).

Figure 10:
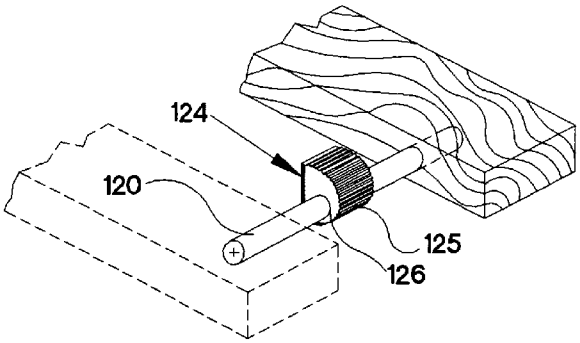
FIG. 10 is a perspective representational view of the cam shim.

As second subassembly 110 is positioned within framed door opening 10, dowels 120 are aligned and inserted into each pair of opposing holes 121, which are located generally along inner edge 150 of first subassembly 101 and inner edge 151 of second subassembly 110 as shown in FIG. 1. Next, second subassembly 110 is squared within the framed door opening. In squaring first subassembly 101 and second subassembly 110 of modular finishing system for framed doors 100, either conventional wedge shims may be employed or, in the alternative, as shown in FIGS. 3 through 6, cam shim 124 may be employed. Referring to FIG. 10, cam shim 124 includes cam lobe 125 having cam hole 126. To utilize, cam shim 124 is slid onto dowel 120 by inserting dowel 120 through cam hole 126. Once both first subassembly 101 and second subassembly 110 are aligned and installed, cam lobe 125 is rotated until the required offset between the subassembly members and the framing members is achieved.

Modular finishing system for framed doors 100 is adjustable in the sense that first subassembly 101 and second subassembly 110 may be employed in finishing a variety of framed door openings 10 having a variety of depths or dimensions from the inside surface of the wall W to the outside surface of the wall W. The varying depths or thicknesses of walls are accommodated by the fact that first subassembly 101 is pushed into framed door opening 10 to the point that first side casing trim member 105, second side casing trim member 106 and first header casing trim member 107 are flush against wall W as shown in FIGS. 3, 4, 5, 6, 7 and 8. Similarly, second subassembly 110 is pushed into framed door opening 10, with dowels 120 and holes 121 aligned and engaged to the point that that third side casing trim member 114, fourth side casing trim member 115 and second header casing member 113 are flush against wall W as shown in FIGS. 5, 6, 7 and 8.

Figure 4:
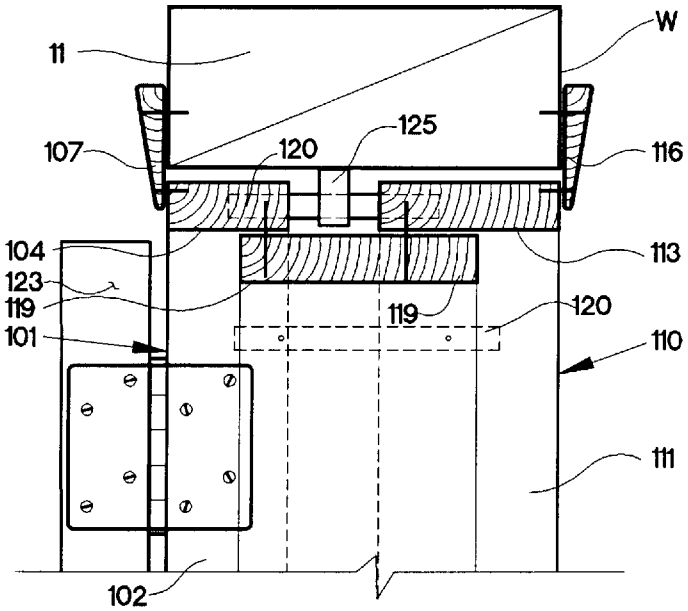
FIG. 4 is a cross-sectional side view of one embodiment of the adjustable framing system for finishing a framed door opening.
Figure 3:
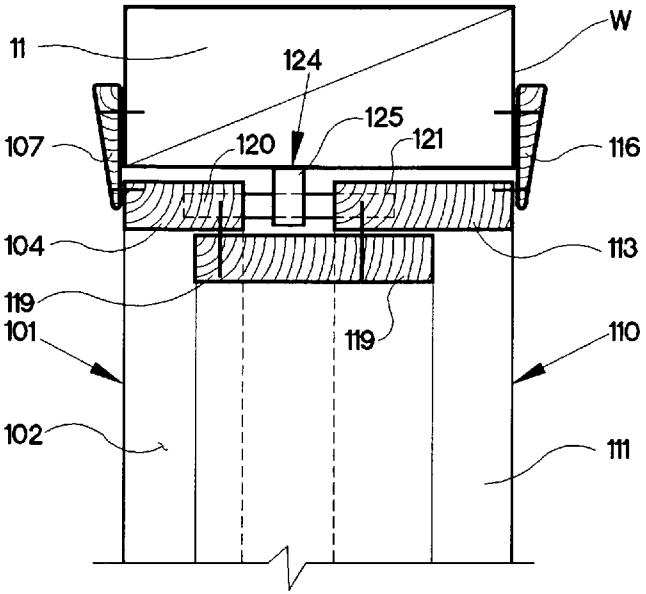
FIG. 3 is a cross-sectional side view of one embodiment of the adjustable framing system for finishing a framed door opening.
Figure 6:
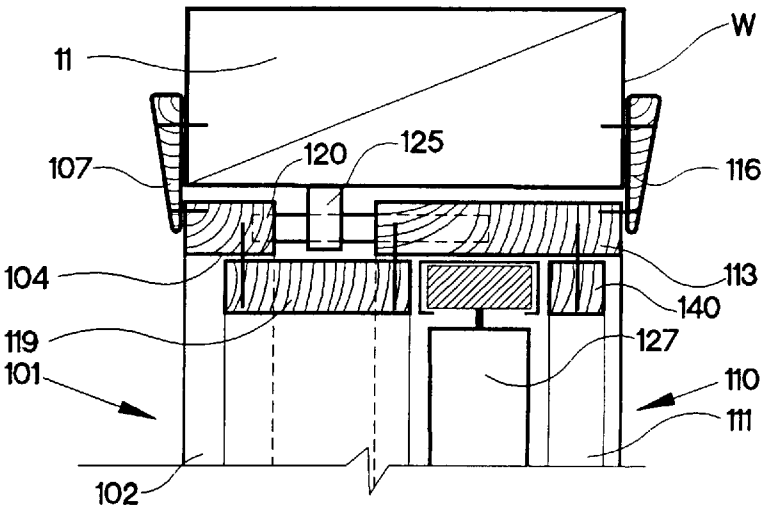
FIG. 6 is a cross-sectional side view of one embodiment of the adjustable framing system for finishing a framed door opening.
Figure 5:
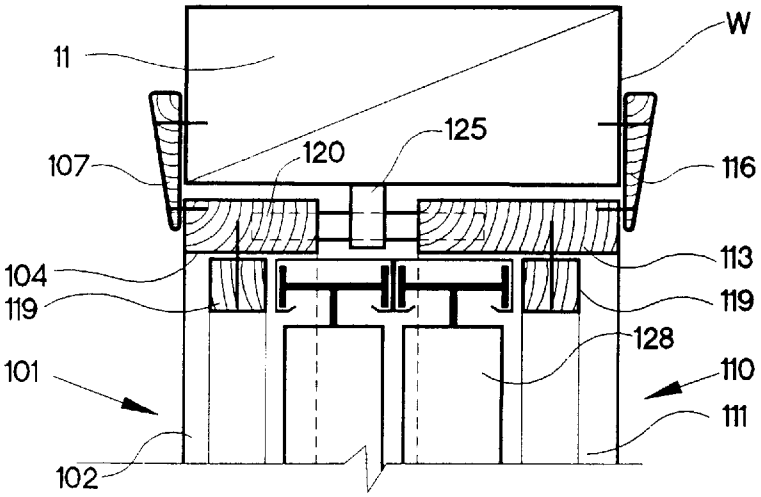
FIG. 5 is a cross-sectional side view of one embodiment of the adjustable framing system for finishing a framed door opening.

As shown in FIGS. 3 through 6, alternative embodiments of modular finishing system for framed doors 100 may include pre-hung door 123 mounted by hinges H, FIG. 4, to first side casing member 102, track doors 128 pre hung from first header casing member 104, FIG. 5, or "bi-fold" door 127 pre hung from first header casing member 104, FIG. 6. FIG. 3 shows the invention employed in a passageway without a door. As shown in FIG. 4, modular finishing system for framed doors 100 may include pre-hung door 123 mounted by hinges H. The present invention allows the installation of both first subassembly 101 and second subassembly 110 with pre-hung door 123 mounted on hinges H, as shown in FIG. 4.

Referring to FIG. 1 and 3 through 6, to finish installation of modular finishing system for framed doors 100, first side stop member 117, second side stop member 118 and header stop member 119 are positioned over any gap between the facing inner edges of the various first and second subassembly members and attached or fastened to the faces of the various first and second subassembly members. In those embodiments employing track doors or "bi-fold" doors an additional trim member 140 may be employed as shown in FIG. 6. Additionally, first side stop member 117, second side stop member 118 and header stop member 119 may be attached either to first side casing member 102, second side casing member 103 and first header casing member 104 or third side casing member 111, fourth side casing member 112 and second header casing member 113 respectively during prefabrication.

Figure 7:
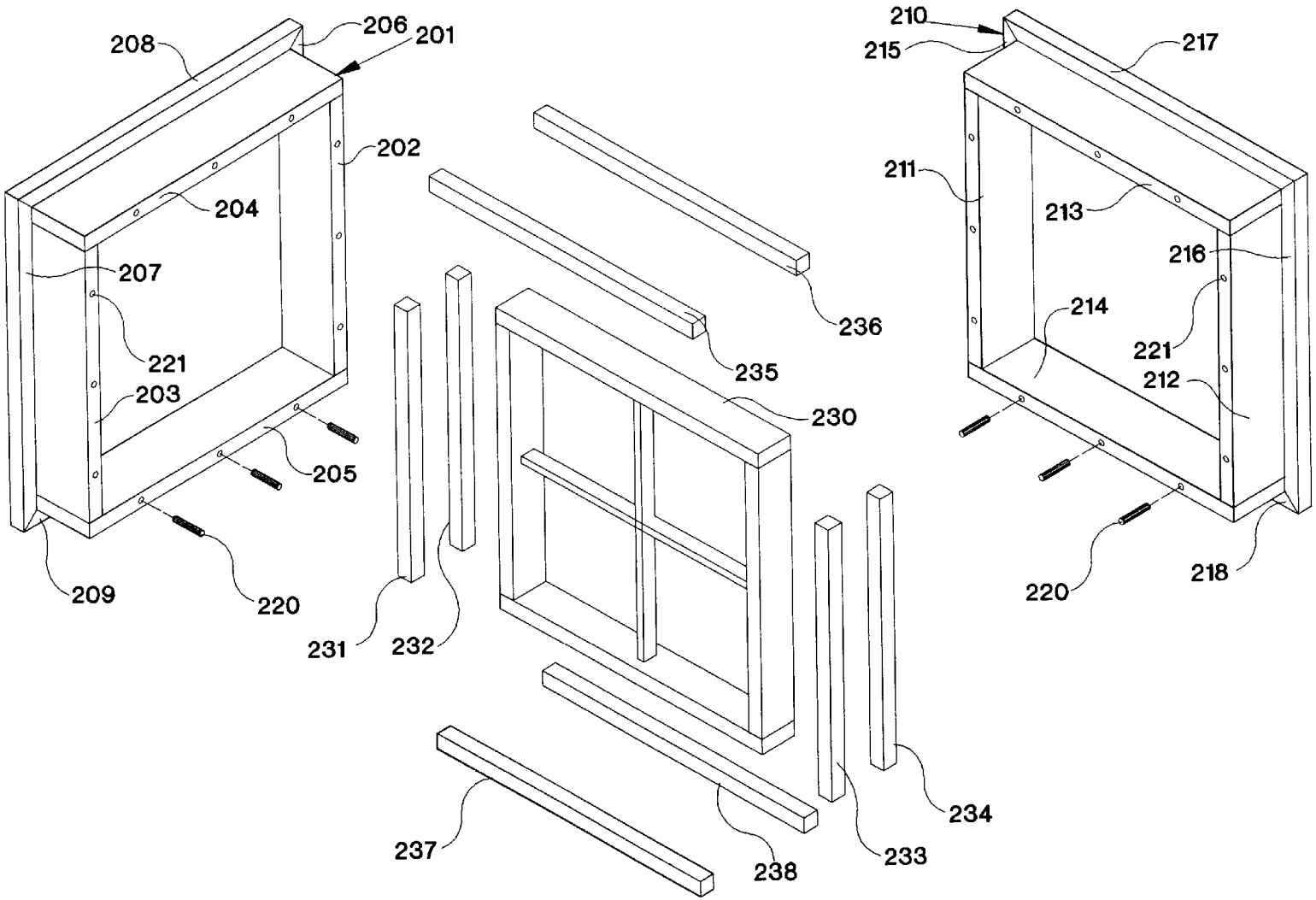
FIG. 7 is a perspective representational view of one embodiment of the adjustable framing system for finishing a framed window opening.
Figure 8:
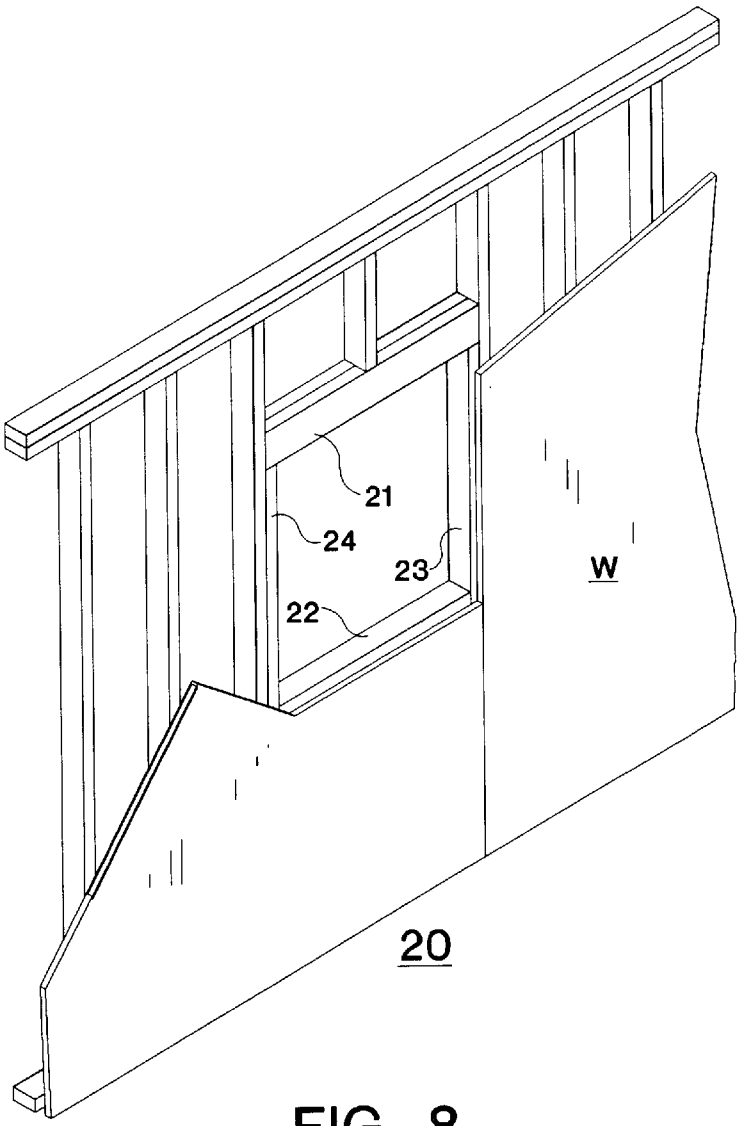
FIG. 8 is a front view of a framed window opening.
Figure 9:
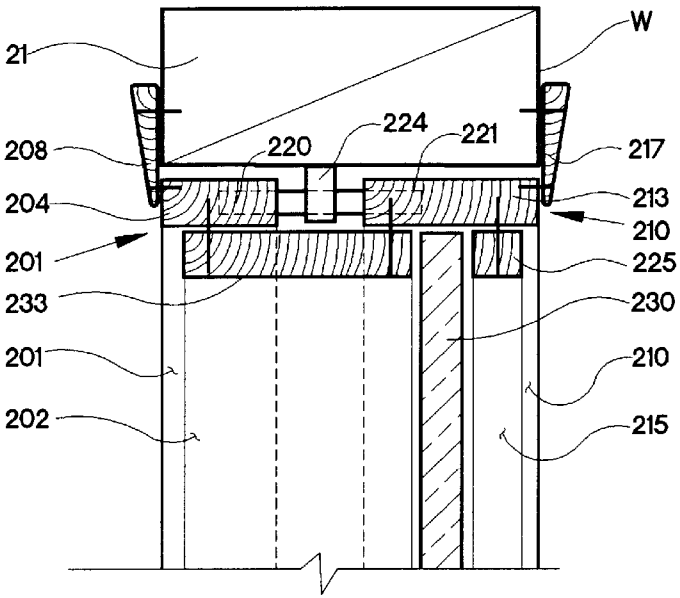
FIG. 9 is a cross-sectional side view of one embodiment of the adjustable framing system for finishing a framed window opening.

Referring now to FIGS. 7 through 9 a modular finishing system for framed window opening is more fully described. Modular finishing system for framed windows 200 is adjustable for varying depths of framed window openings 20. Referring to FIG. 8, framed window opening 20 typically includes header 21, sill plate 22, first side frame member 23 and second side frame member 24. Framed window opening 20 is formed utilizing framing components, typically wood or metal, having nominal or standard dimensions.

Referring to FIGS. 7 and 9, modular finishing system for framed windows 200 includes first subassembly 201, having first side casing member 202, second side casing member 203, first header casing member 204 and first sill casing member 205. First side casing member 202 is configured having an inner edge, an outer edge, a back and a face. Similarly, second side casing member 203 is configured having an inner edge, an outer edge, a back and a face. First side casing member 202 is attached at is upper end to first header casing member 204 and at its lower end to first sill casing member 205. Similarly, second side casing member 203 is attached at is upper end to first header casing member 204 and at its lower end to first sill casing member 205. Both first header casing member 204 and first sill casing member 205 are configured having an inner edge, an outer edge, a back and a face.

Attached to the outer edge of first side casing member 202 is first side casing trim member 206. Similarly, second side casing trim member 207 is attached to the outer edge of second side casing member 203. First header casing trim member 208 is attached to the outer edge of first header casing member 204 and first sill casing trim member 209 is attached to the outer edge of first sill casing member 205.

Second subassembly 210 is similarly prefabricated and includes third side casing member 211, fourth casing member 212, second header casing member 213 and second sill casing member 214. Third side casing member 211 is configured having an inner edge, an outer edge, a back and a face. Similarly, fourth casing member 212 is configured having an inner edge, an outer edge, a back and a face. Third side casing member 211 is attached at its upper end to second header casing member 213 and at its lower end to second sill casing member 214. Similarly, fourth side casing member 212 is attached at is upper end to second header casing member 213 and at its lower end to second sill casing member 214. Second header casing member 213 and second sill casing member 214 are configured having an inner edge, an outer edge, a back and a face.

Attached to the outer edge of third side casing member 211 is third side casing trim member 215. Similarly, fourth side casing trim member 216 is attached to the outer edge of fourth side casing member 212. Second header casing trim member 217 is attached to the outer edge of second header casing member 213 and second sill casing trim member is attached to the outer edge of second sill casing member 214.

Located along the inner edges of first side casing member 202, second side casing member 203, first header casing member 204 and first sill casing member 205 are a plurality of holes 221. Each hole 221 has a longitudinal axis parallel to the face of the casing member in which the hole is formed. Additionally, each hole 221 is substantially aligned longitudinally with at least one hole 221 located along the opposing subassembly inner edges, specifically, third side casing member 211, fourth casing member 212, second header casing member 213 and second sill casing member 214.

Dowels 220 are configured so as to be slideably engagable in each hole 221.

As shown in FIGS. 7 through 9, to install modular finishing system for framed windows 200, first subassembly 201 is erected by positioning within framed window opening 20 so that first header casing member 204 extends across a portion of header 21 with first header casing trim member 208 extending away from framed window opening 20 above adjacent wall section W. First side casing member 202 extends across a portion of first side frame member 22, with first side casing trim member 206 extending away from framed window opening 20 adjacent to the wall section (not shown). Second side casing member 203 extends across a portion of second side frame member 24 with second side casing trim member 207 extending away from framed window opening 20 adjacent to the wall section W. (not shown). Similarly, first sill casing member 205 extends across a portion of sill plate 22 with first sill casing trim member 209 extending away from framed window opening 20 adjacent to the wall section W (not shown).

First subassembly 201 is squared within framed window opening 20, and secured, typically by fastening the various trim members to adjacent wall sections. FIG. 9 shows first header casing trim member 208 so attached to wall section W. This is typical of the arrangement and attachment of the various trim members to adjacent wall sections.

Referring again to FIGS. 7 through 9, second subassembly 210 is erected by first positioning within framed window opening 20 so that second header casing member 213 extends across a portion of header 21 with second header casing trim member 217 extending away from framed window opening 20 adjacent to the wall section W. Third side casing member 211 extends across a portion of first side frame member 22 with third side casing trim member 215 extending away from framed window opening 20 adjacent to the wall section (not shown). Fourth casing member 212 extends across a portion of second side frame member 23 with fourth side casing trim member 216 extending away from framed window opening 20 adjacent to the wall section (not shown). Second sill casing member 214 extends across a portion of sill plate 22 with second sill casing trim member 218 extending away from framed window opening 20 adjacent to the wall section (not shown).

As second subassembly 210 is positioned within framed window opening 20, dowels 220 are aligned and inserted into each pair of opposing holes 221. Next, second subassembly 210 is squared within framed window opening 20, and secured, typically by fastening the various trim members to adjacent wall sections. FIG. 9 shows second header casing trim member 217 so attached to wall section W. This is typical of the arrangement and attachment of the various trim members to adjacent wall sections.

Modular finishing system for framed windows 200 is adjustable in the sense that first subassembly 201 and second subassembly 210 may be employed in finishing a variety of framed window openings 20 having a variety of depths or dimensions from the inside surface of the wall W to the outside surface of the wall W. The varying depths or thicknesses of walls are accommodated by the fact that first subassembly 201 is pushed into framed window opening 20 to the point that first side casing trim member 206, second side casing trim member 207, first header casing trim member 208 and first sill casing trim member 209 are flush against wall W as shown in FIG. 9. Similarly, second subassembly 210 is pushed into framed window opening 20, with dowels 220 and holes 221 aligned and engaged to the point that that third side casing trim member 215, fourth side casing trim member 216, second header casing member 217 and second sill casing trim member 218 are flush against wall W.

In squaring first subassembly 201 and second subassembly 210 of modular finishing system for framed windows 200, either conventional wedge shims may be employed or, in the alternative, as with modular finishing system for framed doors 100 as shown in FIG. 9 cam shim 224 may be employed.

As shown in FIG. 7, to finish installation of modular finishing system for framed windows 200, pre-glazed window 230 is inserted within the finished opening formed by first subassembly 201 and second subassembly 210 and first side first face trim member 231, first side second face trim member 232, second side first face trim member 233, second side second face trim member 234, header first face trim member 235, header second face trim member 236, sill first face trim member 237 and sill second face trim member 238 are positioned and fastened to keep pre-glazed window 230 within the finished opening. Modular finishing system for framed windows 200 may be configured so that either pre-glazed window 230 or the various face trim members are positioned over any gap between the facing inner edges of the various first and second subassembly members and attached or fastened to the faces of the various first and second subassembly members. Additionally, modular finishing system for framed windows 200 may be configured so that first subassembly 201 has first side first face trim member 231, second side first face trim member 233, header first face trim member 235 and sill first face trim member 237 are attached to first side casing member 202, second side casing member 203, first header casing member 204 and first sill casing member 205 respectively during prefabrication. Alternatively, second subassembly 210 may be configured so that first side second face trim member 232, second side second face trim member 234, header second face trim member 236 and sill second face trim member 238 are attached to third side casing member 211, fourth casing member 212, second header casing member 213 and second sill casing member 214 respectively during prefabrication.

Modular finishing system for framed windows 200 may include preglazed window 230, configured as a sliding or hung window or, in the alternative, may simply provide means for mounting a pre-hung or preglazed window within one of the subassemblies following installation. Alternately, modular finishing system for framed windows 200 may be configured simply as a passageway or opening without glass.

While there is shown and described the preferred embodiment of the invention, it is to be distinctly understood that this invention is not limited thereto but may be variously embodied to practice within the scope of the following claims.

We claim:

1. A modular finishing system for framed door openings which is adjustable for varying depths of a door casing comprising:

a first subassembly including a first side casing member having an inner edge and an outer edge, a back and a face, a second side casing member including an inner edge and an outer edge and a first header casing member having an inner edge and an outer edge, a back and a face, the first side casing member inner edge, the second side casing member inner edge and the first header casing member inner edge forming a first subassembly inner edge;

a second subassembly including a third side casing member including an inner edge and an outer edge, a back and a face, a fourth side casing member having an inner edge and an outer edge and a second header casing member having an inner edge and an outer edge, a back and a face, the third side casing member inner edge, the fourth side casing member inner edge and the second header casing member inner edge forming a second subassembly inner edge;

means for permitting the adjustable engagement of the first subassembly with the second subassembly attached to and extending between the first subassembly inner edge and the second subassembly inner edge.

2. The modular finishing system of claim 1 further comprising:

a first side casing trim member attached to the first side casing member outer edge;

a second side casing trim member attached to the second side casing member;

a first header casing trim member attached to the first header casing member;

a third side casing trim member attached to the third side casing member;

a fourth side casing trim member attached to the fourth side casing member; and a second header casing trim member attached to the second header casing member.

3. The modular finishing system of claim 1 wherein the means for permitting the adjustable engagement of the first subassembly with the second subassembly attached to and extending between the first subassembly inner edge and the second subassembly inner edge further comprises:

the first subassembly casing members including a plurality of holes located along the first subassembly inner edge, each of the plurality of holes having a longitudinal axis substantially parallel to the face of the first subassembly casing members;

the second subassembly casing members including a plurality of holes located along the second subassembly inner edge, each of the plurality of holes having a longitudinal axis substantially parallel to the face of the second subassembly casing members; and a plurality of dowels, one dowel slideably engaged in one of the plurality of holes located along the first subassembly inner edge and slideably engageable in one of the plurality of holes located along the second subassembly inner edge.

4. The modular finishing system of claim 3 further comprising a cam shim rotatably mounted on the dowel slideably engaged in one of the plurality of holes located along the first subassembly inner edge and slideably engageable in one of the plurality of holes located along the second subassembly inner edge.

5. A modular finishing system for framed window openings which is adjustable for varying depths of a window casing comprising:

a first subassembly including a first side casing member including an inner edge and an outer edge, a back and a face, a second side casing member having an inner edge and an outer edge and a first header casing member having an inner edge and an outer edge, a back and a face and a first sill casing member having an inner edge and an outer edge, the first side casing member inner edge, the second side casing member inner edge, the first header casing member inner edge and the first sill casing member inner edge forming a first subassembly inner edge;

a second subassembly including a third side casing member including an inner edge and an outer edge, a back and a face, a fourth side casing member having an inner edge and an outer edge and a second header casing member having an inner edge and an outer edge, a back and a face and a second sill casing member having an inner edge and an outer edge, the third side casing member inner edge, the fourth side casing member inner edge, the second header casing member inner edge and the second sill casing member inner edge forming a second subassembly inner edge;

means for permitting the adjustable engagement of the first subassembly with the second subassembly attached to and extending between the first subassembly inner edge and the second subassembly inner edge.

6. The modular finishing system of claim 5 further comprising:

a first side casing trim member attached to the first side casing member outer edge;

a second side casing trim member attached to the second side casing member outer edge;

a first header trim member attached to the first header member;

a first sill casing trim member attached to the first sill member;

a third side casing trim member attached to the third side casing member;

a fourth side casing trim member attached to the fourth side casing member;

a second header casing trim member attached to the second header member; and a second sill casing trim member attached to the first sill member outer edge.

7. The modular finishing system of claim 5 wherein the means for permitting the adjustable engagement of the first subassembly with the second subassembly attached to and extending between the first subassembly inner edge and the second subassembly inner edge further comprises:

the first subassembly casing members including a plurality of holes located along the inner edges of the first subassembly casing members, each of the plurality of holes having a longitudinal axis substantially parallel to the face of the first subassembly casing members;

the second subassembly casing members including a plurality of holes located along the inner edges of the second subassembly casing members, each of the plurality of holes having a longitudinal axis substantially parallel to the face of the second subassembly casing members; and a plurality of dowels, one dowel slideably engaged in one of the plurality of holes located along the inner edges of the first subassembly casing members and slideably engageable in one of the plurality of holes located along the inner edges of the second subassembly casing members.

8. The modular finishing system of claim 7 further comprising a cam shim rotatably mounted on the dowel slideably engaged in one of the plurality of holes located along the inner edges of the first subassembly casing members and slideably engageable in one of the plurality of holes located along the inner edges of the second subassembly casing members.

9. A modular finishing system for framed door openings which is adjustable for varying depths of a door casing comprising:

a first subassembly including a first side casing member having an inner edge and an outer edge, a back and a face, a second side casing member including an inner edge and an outer edge and a first header casing member having an inner edge and an outer edge, a back and a face, the first side casing member inner edge, the second side casing member inner edge and the first header casing member inner edge forming a first subassembly inner edge;

a first side casing trim member attached to the first side casing member outer edge;

a second side casing trim member attached to the second side casing member;

a first header casing trim member attached to the first header casing member;

a second subassembly including a third side casing member including an inner edge and an outer edge, a back and a face, a fourth side casing member having an inner edge and an outer edge and a second header casing member having an inner edge and an outer edge, a back and a face, the third side casing member inner edge, the fourth side casing member inner edge and the second header casing member inner edge forming a second subassembly inner edge;

a third side casing trim member attached to the third side casing member;

a fourth side casing trim member attached to the fourth side casing member;

a second header casing trim member attached to the second header casing member; and means for permitting the adjustable engagement of the first subassembly with the second subassembly attached to and extending between the first subassembly inner edge and the second subassembly inner edge.

10. The modular finishing system of claim 9 further comprising a pre-hung door attached to the first subassembly.

11. The modular finishing system of claim 9, wherein the means for permitting the adjustable engagement of the first subassembly with the second subassembly attached to and extending between the first subassembly inner edge and the second subassembly inner edge further comprises:

the first subassembly casing members including a plurality of holes located along the first subassembly inner edge, each of the plurality of holes having a longitudinal axis substantially parallel to the face of the first subassembly casing members;

the second subassembly casing members including a plurality of holes located along the second subassembly inner edge, each of the plurality of holes having a longitudinal axis substantially parallel to the face of the second subassembly casing members; and a plurality of dowels, one dowel slideably engaged in one of the plurality of holes located along the first subassembly inner edge and slideably engageable in one of the plurality of holes located along the second subassembly inner edge.

12. The modular finishing system of claim 11 further comprising a cam shim rotatably mounted on the dowel slideably engaged in one of the plurality of holes located along the first subassembly inner edge and slideably engageable in one of the plurality of holes located along the second subassembly inner edge.

13. A modular finishing system for framed window openings which is adjustable for varying depths of a window casing comprising:

a first subassembly including a first side casing member including an inner edge and an outer edge, a back and a face, a second side casing member having an inner edge and an outer edge and a first header casing member having an inner edge and an outer edge, a back and a face and a first sill casing member having an inner edge and an outer edge, the first side casing member inner edge, the second side casing member inner edge, the first header casing member inner edge and the first sill casing member inner edge forming a first subassembly inner edge;

a first side casing trim member attached to the first side casing member outer edge;

a second side casing trim member attached to the second side casing member outer edge;

a first header trim member attached to the first header member;

a first sill casing trim member attached to the first sill member;

a second subassembly including a third side casing member including an inner edge and an outer edge, a back and a face, a fourth side casing member having an inner edge and an outer edge and a second header casing member having an inner edge and an outer edge, a back and a face and a second sill casing member having an inner edge and an outer edge, the third side casing member inner edge, the fourth side casing member inner edge, the second header casing member inner edge and the second sill casing member inner edge forming a second subassembly inner edge;

a third side casing trim member attached to the third side casing member;

a fourth side casing trim member attached to the fourth side casing member;

a second header casing trim member attached to the second header member;

a second sill casing trim member attached to the first sill member outer edge; and means for permitting the adjustable engagement of the first subassembly with the second subassembly attached to and extending between the first subassembly inner edge and the second subassembly inner edge.

14. The modular finishing system of claim 13 further comprising a pre-glazed window mounted in the first subassembly.

15. The modular finishing system of claim 13 wherein the means for permitting the adjustable engagement of the first subassembly with the second subassembly attached to and extending between the first subassembly inner edge and the second subassembly inner edge further comprises:

the first subassembly casing members including a plurality of holes located along the first subassembly inner edge, each of the plurality of holes having a longitudinal axis substantially parallel to the face of the first subassembly casing members;

the second subassembly casing members including a plurality of holes located along the second subassembly inner edge, each of the plurality of holes having a longitudinal axis substantially parallel to the face of the second subassembly casing members; and a plurality of dowels, one dowel slideably engaged in one of the plurality of holes located along the first subassembly inner edge and slideably engageable in one of the plurality of holes located along the second subassembly inner edge.

16. The modular finishing system of claim 15 further comprising a cam shim rotatably mounted on the dowel slideably engaged in one of the plurality of holes located along the first subassembly inner edge and slideably engageable in one of the plurality of holes located along the second subassembly inner edge.

* * * * *